US006568840B1

(12) United States Patent
Mabe et al.

(10) Patent No.: US 6,568,840 B1
(45) Date of Patent: May 27, 2003

(54) VEHICLE LAMP

(75) Inventors: Michihiro Mabe, Shizuoka (JP); Koichi Nakamura, Shizuoka (JP)

(73) Assignee: Koito Manufacturing Co., Ltd. (JP)

( * ) Notice: Subject to any disclaimer, the term of this patent is extended or adjusted under 35 U.S.C. 154(b) by 0 days.

(21) Appl. No.: 09/522,987

(22) Filed: Mar. 10, 2000

(30) Foreign Application Priority Data

Mar. 26, 1999 (JP) ..... 11-083064

(51) Int. Cl.[7] ..... F21V 7/00

(52) U.S. Cl. ..... 362/516; 362/219; 362/509; 362/341; 362/310; 313/113

(58) Field of Search ..... 362/516, 296, 362/520, 509, 19, 341, 343, 342, 310; 445/58, 22; 313/113

(56) References Cited

U.S. PATENT DOCUMENTS 3,852,583 A * 12/1974 Puyplat ..... 362/516
4,287,231 A * 9/1981 DeCaro et al. ..... 427/106
4,506,315 A * 3/1985 Maekawa et al. ..... 362/308
5,343,370 A 8/1994 Ohashi et al. ..... 362/61
5,353,210 A * 10/1994 Strok et al. ..... 362/293
5,607,228 A 3/1997 Ozaki et al. ..... 362/263
6,000,814 A * 12/1999 Nestell et al. ..... 362/267
6,352,359 B1 * 3/2002 Shie et al. ..... 362/522

* cited by examiner

*Primary Examiner*—Sandra O'Shea
*Assistant Examiner*—Bertrand Zeade
(74) *Attorney, Agent, or Firm*—Fish & Richardson P.C.

(57) ABSTRACT

A vehicle lamp formed by integrally molding a lens and a lamp body, which can be practically applied is described. A vehicle lamp 1 is formed by integrally molding a lens 2 and a lamp body 3 using a light permeable resin material. A reflection layer 10 is coated on the outer surface 301 of the lamp body 3 and reflects light P0 emitted from a light source 15 located within the lamp body 3 forward to the front of the lamp body.

16 Claims, 4 Drawing Sheets

FIG. 3 - (A)
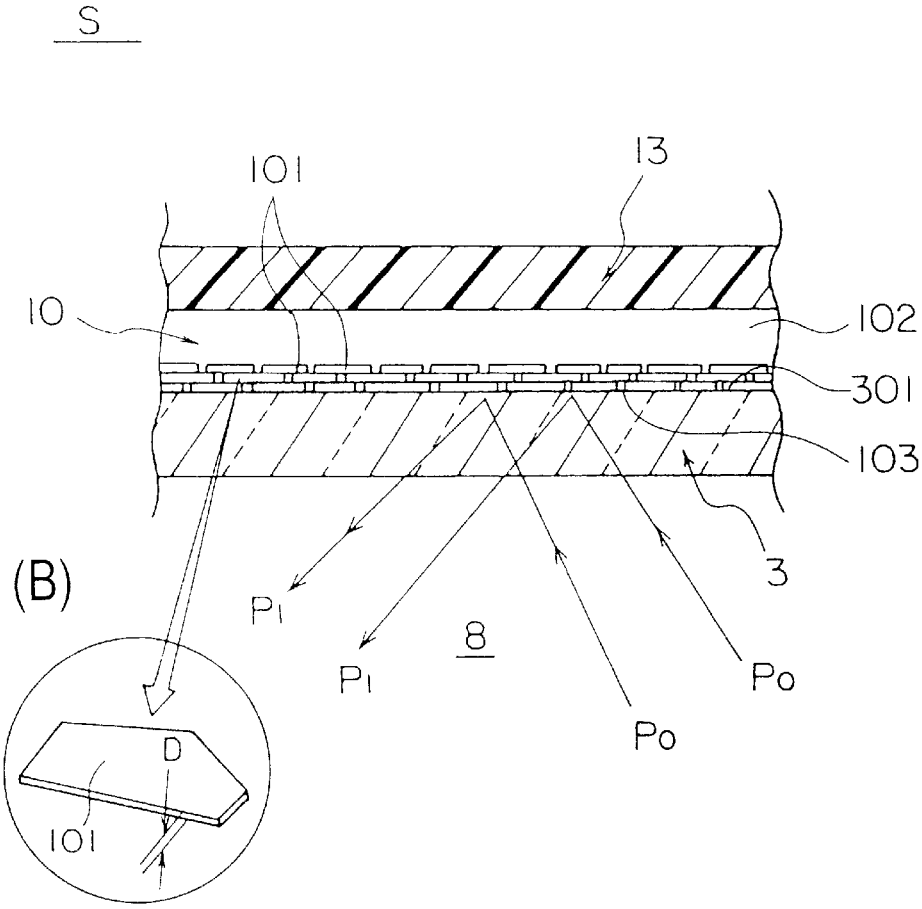
FIG. 3 - (B)

FIG. 4 - (A)
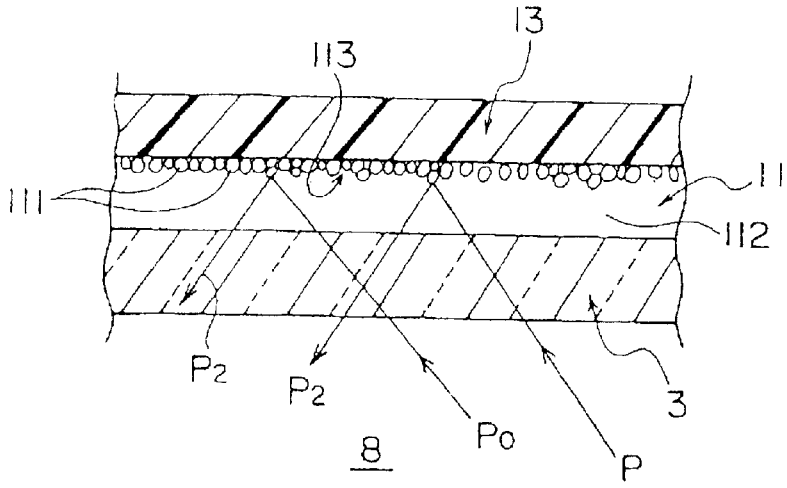
FIG. 4 - (B)
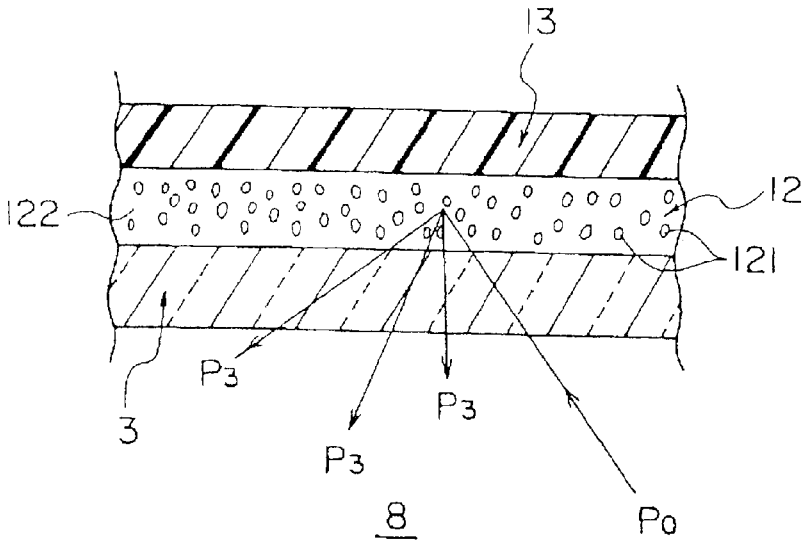

FIG. 5

| STATE OF ALUMINUM PIGMENT | GRANULATION | | FLAKE |
|---|---|---|---|
| | SUSPENDED | DISPERSED | |
| CENTER REFLECTANCE | 45% | 12% | 68% |
| DIFFUSE REFLECTANCE | 22% | 39% | 7% |
| TOTAL REFLECTANCE | 67% | 51% | 75% |
| | 11 | 12 | 10 |

VEHICLE LAMP

BACKGROUND OF THE INVENTION

The present invention relates to a vehicle lamp, and more particularly, to a vehicle lamp formed by integrating a lens and a lamp body, the outer surface of which is coated with a reflection layer.

Conventionally, a vehicle lamp for use with a motor vehicle or the like was fabricated by integrally forming a lamp body of the vehicle lamp and a (front) lens. The front lens passes light from a light source located within a lamp chamber of the lamp body and then radiates that light to the outside. Such vehicle lamps were made of a light permeable resin material and fabricated using a blow molding process or the like. In order to form a reflection layer for reflecting light from the light source, an immersion process referred to as "dip brazing" has been generally employed to coat the reflection layer on the inner surface of the lamp body. In the immersion process, the hole used to connect the light source, formed at the rear top portion of the lamp body, has been utilized as the opening through which the paint for immersion is filled. After immersing the entire lamp body such that the paint adheres to the inner surface thereof, the lamp body is lifted up and the adhered paint is dried to form the reflection layer.

Through the aforementioned process, the resultant reflection layer is formed on the side closest to the light source such that there is substantially no light loss due to the influence of the lamp body member. The resultant reflection layer, therefore, is considered as being preferable because the layer can efficiently reflect the light emitted from the light source.

When integrating the lens and the lamp body, however, the inner surface of the lamp body becomes substantially closed by the lens and the lamp body member. Therefore, in order to form the reflection layer by coating the inner surface of the lamp body, the aforementioned dip brazing process necessitates steps and a structure which are complex and troublesome. Thus, such processes require improvement, and technology for forming the reflection layer on the outer side of the transparent lamp body has gathered attention.

When forming the reflection layer on the outer side of the lamp body, it is necessary to cope with various problems. In particular, damage or peeling of the reflection layer is likely to occur due to abutment against tools during attachment to the vehicle. Moreover, it is desirable to maximize the reflectance of the reflection layer corresponding to the light from the light source reaching the reflection layer via the lamp body member. The problems concerning peeling of the reflection layer and improving the reflectance of the reflection layer have been obstacles preventing vehicle lamps formed by integrating the lens and the lamp body from being popular in the market.

SUMMARY OF THE INVENTION

The present invention provides a vehicle lamp having a lens and a lamp body integrated so as to be suitable for practical application. A reflection layer is formed on the outer side of the lamp body that can be effectively protected. The reflection layer is structured so as to improve the light reflectance, and may be formed with a protection film on the outer side of the reflection layer.

A vehicle lamp formed by integrally molding a lens and a lamp body through a blow molding process using a light permeable synthetic resin material is presented. A reflection layer for reflecting the radiated light emitted from a light source located within the lamp body to the forward of the lamp body is coated onto the outer surface of the lamp body. Since the reflection layer is coated onto the outer surface of the lamp body, the reflection layer forming step for producing a vehicle lamp having an integrated lens and lamp body is simplified.

Implementations of the invention may include one or more of the following features. A surface layer of the reflection layer may be coated with a protection film layer. Such a protective film prevents the reflection layer formed on the outer side of the lamp body from being damaged or peeled due to abutment against tools during assembly to the vehicle, and serves to improve weather resistance. The reflection layer may be formed of an aluminum paint. The aluminum pigment contained in the reflection layer reflects light formed from the light source to the inner side of the lamp body. A reflection surface may be formed by depositing an aluminum powder as a pigment blended with the aluminum paint on the outer surface of the lamp body. In this case, the reflection surface is formed by aluminum powder deposited on the outer surface of the lamp body member rather than being dispersed or suspended within the reflection layer. Therefore, the light admitted through the lamp body member can be immediately reflected, thus reducing light loss. The aluminum powder may be formed of thin flake-shaped aluminum pieces. The thin flake-shaped aluminum pieces may be oriented and deposited on the outer surface of the lamp body. The result is a uniform and smooth reflection surface that minimizes light scattering, thus improving the reflectance of the reflection layer.

An embodiment of the present invention will be described referring to the accompanying drawings.

BRIEF DESCRIPTION OF THE DRAWINGS

FIG. 3(A) is an enlarged cross-sectional view of a section S of FIG. 2 on the periphery of the lamp body member of the molded article including the reflection layer and the protection film layer formed thereon.

FIG. 3(B) is an enlarged view of a flake-shaped aluminum piece contained in the reflection layer used as the pigment.

FIG. 4(A) is an enlarged cross-sectional view of a section in the periphery of the lamp body member using the reflection layer formed in the state where the granular aluminum powder used as the paint pigment is suspended.

FIG. 4(B) is an enlarged cross-sectional view of a section in the periphery of the lamp body member using the reflection layer formed in the state where the granular aluminum powder using as the paint pigment is dispersed.

FIG. 5 is a table including data corresponding to the reflectance of light with respect to the reflection layer according to the state of the aluminum pigment.

DETAILED DESCRIPTION

Figure 1:
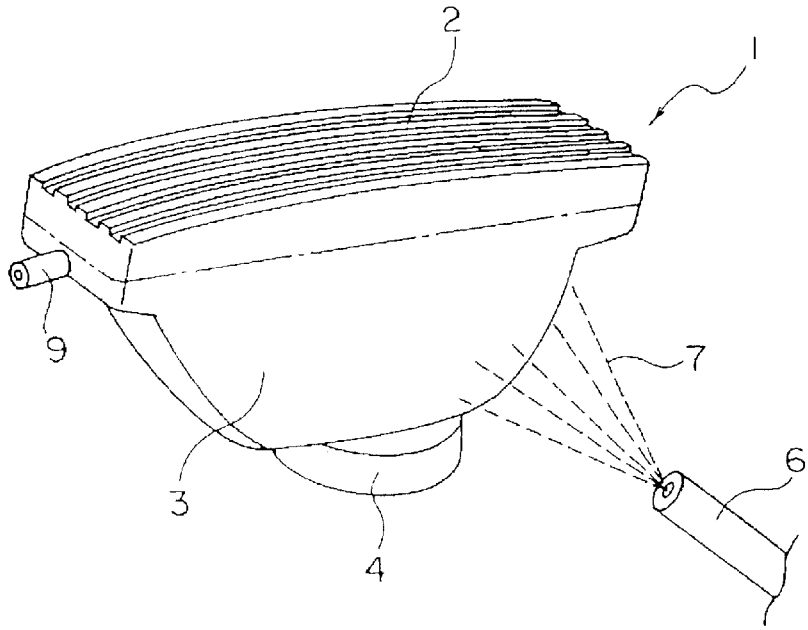
FIG. 1 is a general perspective view of a molded article according to the present invention obtained by integrally forming the lens and the lamp body.

FIG. 1 is an overall perspective view of a vehicle lamp formed by integrating a lens and a lamp body. A reference numeral 1 represents a molded article constituting the vehicle lamp formed by integrally molding a lens 2 and a lamp body 3 through a method such as blow molding.

Blow molding is used to form a hollow molded article by expanding a parison (of resin) or a sheet using air pressure or the like within a joined metal die so that it is in tight contact with the die and is cooled for solidification. It is to be understood, however, that the integral molding process for forming the molded article 1 constituting the body of the vehicle lamp is not limited to blow molding.

The molded article 1 constituting the vehicle lamp body is formed of a light permeable synthetic resin material. Therefore, when the integral molding process is finished, the lens 2 and the lamp body 3 constituting the molded article 1 are formed to be transparent as a whole. An air inlet 9 is formed in the lamp body 3 using an air blow supply hole for blow molding the molded article 1 so that the lamp chamber 8 can be ventilated.

Figure 2:
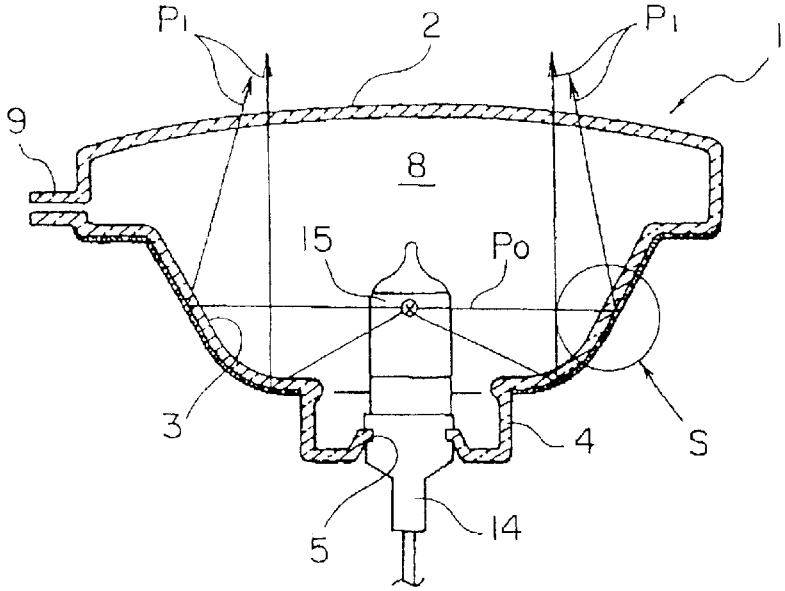
FIG. 2 is a longitudinal cross-sectional view of the molded article with the light source installed.

Once integrally molded, the molded article is ready for application of a reflection layer 10 (see FIG. 2). In this process, the reflection layer 10 is formed by spraying a paint 7 on the outer surface 301 of the lamp body 3 with a sprayer 6 or the like and drying it for a predetermined time in a drying oven.

FIG. 2 is a longitudinal cross-sectional view of the vehicle lamp on which a reflection layer and a protection film layer are formed. The reflection layer 10 allows light P0 radiated from a light source 15, which is disposed in a light source fitting hole 5 formed inside a light source fitting portion 4 via a bulb socket 14, to pass through a layer of the transparent lamp body 3 that surrounds the periphery of the light source 15. The light P0 is then reflected by the reflection surface 103 of the reflection layer 10, passes through the layer of the lamp body 3 again and is reflected to the inside of the lamp chamber 8 (see FIG. 2).

The outer surface of the reflection layer 10 is further coated with a protection film layer 13 using a synthetic resin material. The protection film layer 13 serves to prevent the reflection layer 10 from being easily damaged or peeled due to abutment against tools during lamp connection to the vehicle, as well as to improve weather resistance.

Specific implementations (structures) of the lamp body 3 and the reflection layer 10 will be described below.

When forming the reflection layer, the molded article 1 that has been through the molding step is turned upside down and sprayed with a paint 7 using a sprayer 6 or the like from above the lamp body 3. The paint 7 has an aluminum coating (also called "aluminum paint"), and is prepared by blending thin, flake-shaped aluminum pieces 101 as a pigment with an oil varnish 102 formed by heating and dissolving a resin (acrylic silicone resin or the like)and a drying oil. The reflection layer formed of the aluminum paint yields excellent reflecting efficiency.

FIG. 3(*a*) is an enlarged cross-sectional view of a portion in the vicinity of a lamp body member S of FIG. 2 of the vehicle lamp on which the reflection layer and the protection film layer are formed. FIG. 3(B) is an enlarged view of a flake-shaped aluminum element contained in the reflection layer as a pigment. The aluminum flakes 101 are normally formed by subjecting a polyester film to aluminum deposition and then peeling the aluminum deposited portion of the thin film (aluminum foil) from the polyester film and grinding it into pieces. The aluminum paint is sprayed from above the lamp body 3, and the aluminum flakes 101 having a specific gravity higher than that of the oil varnish 102 are deposited and oriented so that they are laminated on the outer surface 301 of the lamp body 3. The aluminum flakes thus form a uniform and smooth reflection surface 103.

The aluminum flakes 101 are mixed with an additional agent for providing so-called "wet-ability" such that the aluminum flakes 101 can be spread over the outer surface 301 of the lamp body 3 uniformly and be reliably deposited thereon. The aluminum flakes 101 that sink to the bottom of the reflection layer 10 against the lamp body 3 are further mixed with a predetermined coupling agent so as to tightly adhere onto the outer surface 301 of the lamp body, thus further ensuring formation of the uniform reflection surface 103.

Referring to FIG. 3A, the light P0 radiated from the light source 15 (see FIG. 2) penetrates the lamp body member 3 and is admitted to the reflection surface 103 formed at the interface between-the lamp body 3 and the reflection layer 10, from where a reflecting light P1 is radiated to the lamp chamber 8 inside the lamp body 3, towards the front of the lens 2.

When the thickness D of an aluminum flake 101 is less than 0.01 $\mu$m, the light P0 may penetrate the aluminum flakes constituting the reflection surface 103, thus reducing the center reflectance (center luminous intensity). When the thickness D of each flake 101 becomes 0.6 $\mu$m or greater, there may be too much space between the deposited and laminated aluminum flakes of the reflection surface 103. This is not desirable in view of forming the uniform reflection surface 103. Therefore, the thickness D of the aluminum pieces 101 should be in a range from 0.01 $\mu$m to 0.6 $\mu$m By adjusting the mixture ratio of the aluminum pigment formed of the aluminum flakes 101 to the oil varnish 102, or by selecting an oil varnish 102 exhibiting a specific gravity that facilitates deposition of the aluminum pigment (a suitable specific gravity is 2.6), a predetermined layer of the oil varnish 102 can be formed on the upper layer of the aluminum pieces 101 deposited on the outer surface of the lamp body 3. In this case, the protection film layer 13 can be eliminated, simplifying the whole process for forming the reflection layer 10. The smallest amount possible of the oil varnish 102 is preferred to prevent a decrease in luminance.

FIG. 4(A) is an enlarged cross-sectional view of a part in the vicinity of the lamp body member having a reflection layer formed in a state where the granular aluminum powder used as the pigment is suspended. In the case where reflection layer 11 is formed by coating the aluminum paint formed of granular aluminum powder 111 as shown by FIG. 4(A), the aluminum powder 111 is densely suspended on the surface layer of the oil varnish 112. The reflection surface 113, therefore, is formed at a position spaced apart from the lamp body 3, that is, on the periphery of the surface layer of the reflection layer 11. In this configuration, the light P0 penetrates through the oil varnish layer 112 reaching the reflection surface 113, and thus the reflected light P2 may have an increased light loss due to the penetration. Additionally, the reflection surface 113 has a rough surface which is likely to cause light scattering, and the center reflectance is decreased which is not suitable for a reflection layer.

FIG. 4(B) is an enlarged cross-sectional view of a part in the vicinity of the lamp body member using the reflection layer formed in a state where the granular aluminum powder used as the pigment is dispersed. The granular aluminum powder 122 constituting the aluminum pigment may be dispersed within the oil varnish 122 due to interaction with the components therein. In this case, the resultant reflection surface is not flat, and the light P0 is admitted to the surface of the respective aluminum powder 121. As a result, light scattering P3 increases and the reflection factor largely decreases, which is not suitable for a reflection surface.

The granular aluminum powders 111, 121 can be prepared by crushing an aluminum foil together with an aliphatic lubricant such as stearic acid by stamping or a wet type ball mill.

FIG. 5 illustrates a table summarizing data obtained by measuring the reflectance of light of the reflection layer classified by state of the aluminum pigment. The center reflectance, diffuse reflectance, and total reflectance of each of the reflection layers 10, 11, 12 representing different states of the aluminum pigment have been measured using a reflectivity meter. The total reflectance is equal to the addition to the diffuse reflectance and the total reflectance. The table of FIG. 5 shows a comparison of the data from these measurements. The reflection characteristics of each state of the aluminum pigment will be hereinafter examined with reference to FIG. 5.

Referring to FIG. 5, the center reflectance (center luminous intensity) of the reflection layer 11 representing the state of the suspended granular aluminum and the reflection layer 12 representing the state of the dispersed granular aluminum are measured as 45% and 12%, respectively. It is obvious that those values are lower than the center reflectance of 68% of the reflection layer 10, representing the state where the flake-shaped aluminum pieces are deposited in the lamp body 3. In addition, the diffuse reflectances of the reflection layers 11, 12 are measured 22% and 39%, respectively, while the diffuse reflectance of the reflection layer 12 is measured 7%, which is extremely low in comparison. Furthermore, the total reflectances of the reflection layers 11, 12 are measured as being 67% and 51%, respectively, while the total reflectance of the reflection layer 12 is 75%, which is extremely high in comparison.

The above measurement data shows that the reflection layer 12 having the reflection surface 103 formed on the outer surface 301 of the lamp body has excellent characteristics of efficient reflection without causing great loss of the light radiated from the light source 15. The reflection layer 12 is prepared by reliably depositing and orienting the paint, which uses flake-shaped aluminum pieces 101 as the aluminum pigment. Further, the aluminum pieces 101 themselves, are adhered onto the outer surface 301 of the lamp body.

According to the present invention, when a molded article constituting the body of the vehicle lamp is formed by integrating the lens and the lamp body through means such as blow molding, a reflection layer is formed not on the inner surface of the closed lamp body but on the outer surface thereof. As a result, expensive and troublesome processes such as the immersion process can be eliminated, thus simplifying the reflection layer forming step and improving workability. By forming a protection film layer on the surface of the reflection layer coated on the outer surface of the lamp body, external damage (peeling) can be effectively prevented and weather resistance can be improved.

The reflection layer is formed of the aluminum paint mixed with the aluminum pigment formed of flake-shaped aluminum pieces, and the aluminum pieces are oriented and deposited so that a uniform and smooth reflection surface is formed. This structure makes it possible to efficiently reflect light emitted from the light source to the lens, increasing the light radiated forward from the lens. As a result, visibility in the front irradiation area is improved and visibility in the front view can be greatly improved by the enhanced luminance in the luminous portion.

What is claimed is:

1. A vehicle lamp comprising:

an integrally molded lens and a lamp body of a light permeable synthetic resin material; and a reflection layer coated on the outer surface of said lamp body for reflecting light emitted from a light source located within said lamp body forward towards the lens.

2. A vehicle lamp according to claim 1 further comprising a protection film layer coating a surface layer of said reflection layer.

3. A vehicle lamp according to claim 1 wherein said reflection layer is formed of an aluminum paint.

4. A vehicle lamp according to claim 3 wherein a reflection surface is formed by depositing aluminum powder as a pigment blended with said aluminum paint on the outer surface of said lamp body.

5. A vehicle lamp according to claim 4 wherein said aluminum powder is formed of thin flake-shaped aluminum pieces.

6. A method of forming a vehicle lamp comprising:

integrally molding a lens and lamp body of a light-permeable synthetic resin material; and coating a portion of an outer surface of the lamp body with a uniform reflection layer.

7. The method of claim 6 further comprising forming an air inlet in the lamp body.

8. The method of claim 6 wherein the lens and lamp body are formed using a blow molding process.

9. The method of claim 6 wherein the coating step comprises turning the molded article upside down and spraying it with a reflective paint.

10. The method of claim 9 wherein an aluminum paint is used.

11. The method of claim 10 wherein the aluminum paint is formed by blending thin, flake-shaped pieces with an oil varnish.

12. The method of claim 11 wherein the thickness of the aluminum flakes is in the range of 0.01 $\mu$m to 0.06 $\mu$m.

13. The method of claim 11 wherein the mixture ratio of aluminum flakes to oil varnish has a specific gravity of 2.6.

14. The method of claim 10 wherein the aluminum paint includes a protective film layer.

15. The method of claim 10 wherein the aluminum paint includes a wetting agent to improve spreadability.

16. The method of claim 10 wherein the aluminum paint includes a coupling agent to improve adherence of the paint to the lamp body.

* * * * *